United States Patent [19]

Yamamoto

[11] Patent Number: 4,660,581

[45] Date of Patent: Apr. 28, 1987

[54] METHOD OF FORMING PERMANENT WAVES ON HAIR

[76] Inventor: Hisahiro Yamamoto, 504, Sannoudai Manshon, 7-3-22, Sannou, Akita-shi, Akita, Japan

[21] Appl. No.: 627,569

[22] PCT Filed: Oct. 26, 1983

[86] PCT No.: PCT/JP83/00381

§ 371 Date: Jul. 17, 1984

§ 102(e) Date: Jul. 17, 1984

[87] PCT Pub. No.: WO84/01699

PCT Pub. Date: May 10, 1984

[30] Foreign Application Priority Data

Oct. 27, 1982 [JP] Japan ..... 57-189678

[51] Int. Cl.[4] ..... A45D 7/04

[52] U.S. Cl. ..... 132/7; 132/31 R; 132/39

[58] Field of Search ..... 132/1 R, 5, 7, 9, 31 R, 132/32 R, 32 A, 32 B, 45 R, 45 A, 88.7, 39

[56] References Cited

U.S. PATENT DOCUMENTS

| | | | |
|---|---|---|---|
| 31,234 | 1/1861 | George | 132/32 A |
| 271,052 | 1/1883 | Fishwick | 132/32 A |
| 1,380,064 | 5/1921 | Hoffman | 132/32 A |
| 1,591,207 | 7/1926 | Berthelsen | 132/32 A |
| 2,819,722 | 1/1958 | Spilo et al. | 132/7 |
| 4,398,549 | 8/1983 | Thomas | 132/45 R |

*Primary Examiner*—Gene Mancene
*Assistant Examiner*—David I. Tarnoff
*Attorney, Agent, or Firm*—McGlew and Tuttle

[57] ABSTRACT

A bundle of hair is clamped between a pair of corrugated curling members having alternate ridges and grooves at a predetermined pitch with a predetermined curvature, and then coated with a permanent waving solution to thereby form successive permanent waves on the hair bundle. The hair bundle clamped between the curling members is thereafter immersed in a neutralizing solution to neutralize the hair.

2 Claims, 2 Drawing Figures

FIG. 1
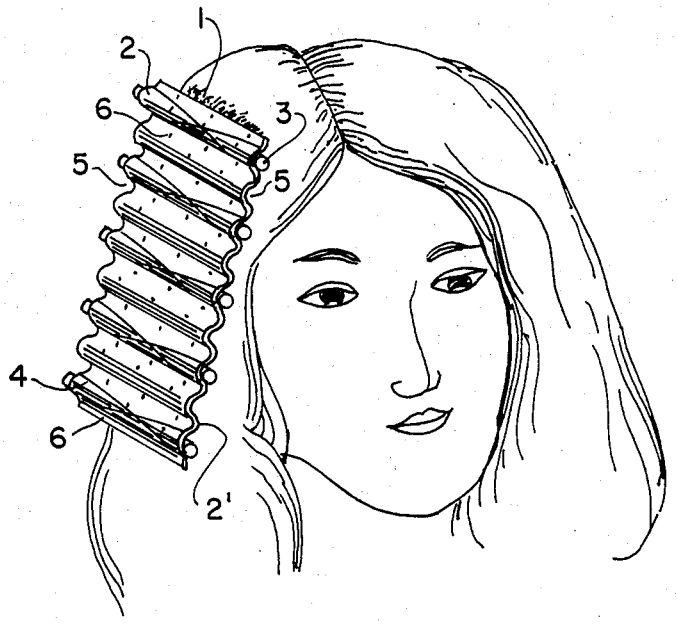
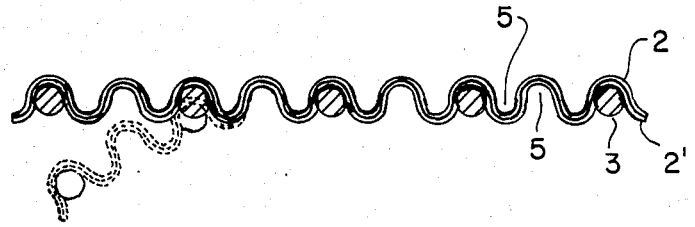
FIG. 2

METHOD OF FORMING PERMANENT WAVES ON HAIR

BACKGROUND OF THE INVENTION

1. Field of the Invention

The present invention relates to a method of forming successive permanent waves on hair vertically along the surface of the head.

2. Description of the Prior Art

It has been customary practice to form vertical permanent waves by winding bundles of hair around a number of curlers one by one. Therefore, conventional permanent waving has been a tedious and time-consuming task. Hair is neutralized by applying a neutralizing solution (known as the second solution for permanent waving) on hair around each curler since it is impossible to immerse the head with the curlers attached thereto in a container of such neutralizing solution for simple and quick permanent waving. During neutralizing, it is necessary to use a towel to absorb the neutralizing solution dripping from hair. Such a neutralizing process is uneconomical, ineffective and harmful to hair as it cannot be sufficiently neutralized.

SUMMARY OF THE INVENTION

It is an object of the present invention to provide a method of forming permanent waves on hair in quick and simple operation while neutralizing hair through economical use of a neutralizing solution in a simple process and simultaneously enabling sufficient neutralization for better hair protection.

According to the present invention, a bundle of hair, regardless of its length, is all sandwiched between a pair of rectangular corrugated curling members each having arcuate or wavy ridges and grooves alternately arranged longitudinally at equal pitch with equal curvature and also having small holes defined therein. The corrugated curling members are complementarily fitted and fastened together by means of rods each fitted in every other groove in one of the curling members and rubber bands looped around the rods. The fastened corrugated curling members with hair sandwiched are immersed in a container of a neutralizing solution which finds its way through the holes in the curling members to the hair.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 1 is a perspective view illustrative of permanent waving according to a method of the present invention; and FIG. 2 is a fragmentary longitudinal cross-sectional view of a pair of corrugated curling members employed in the method of the present invention.

DESCRIPTION OF THE PREFERRED EMBODIMENT

Permanent waving according to the present invention is performed by using a pair of rectangular corrugated curling members as shown in FIGS. 1 and 2. A relatively flat and thin bundle of hair 1 is coated with a permanent waving solution (the first solution for permanent waving) and then sandwiched between a pair of upper and lower rectangular corrugated curling members 2, 2'. Rods 3 are transversely attached to the lower corrugated curling member 2', and the upper and lower corrugated curling members 2, 2' are fastened complementarily together by rubber bands 4 looped around the exposed ends of the rods 3 and extending across the upper corrugated curling member 2. Thus, the bundle of hair 1 is firmly clamped between the corrugated curling members 2, 2'.

Each of the corrugated curling members 2, 2' is of an area required for a desired amount of hair to be permanently waved and has arcuate or wavy ridges and grooves 5 alternately arranged longitudinally at a predetermined pitch with a predetermined curvature. The corrugated curling members 2, 2' or only one of them has small holes 6 defined therethrough in a desired pattern. The rods 3 are fitted in every other groove in the lower corrugated curling member 2', as shown in FIG. 2, which is complementarily fitted with the upper corrugated curling member 2. While the currugated curling members 2, 2' are shown in FIG. 1 as being substantially straight, they may be curved along the head of a user as shown by the imaginary lines in FIG. 2.

After the hair bundle 1 has been curled or "permed" between the corrugated curling members 2, 2' by the permenent waving solution, the hair as sandwiched between the corrugated curling members 2, 2' is immersed in a container (not shown) in the shape of a rectangular parallelpiped containing a neutralizing solution (the second solution for permanent waving). The neutralizing solution enters through the small holes 6 in the curling members 2, 2' into the hair bundle 1 to neutralize the same. The hair bundle 1 is now permanently waved. Since the hair is neutralized by immersing the same in the container of neutralizing solution, the solution may be of a lower concentration than that of the neutralizing solution used in the conventional permanent waving method.

With the permanent waving process of the invention, a number of vertically arranged permanent waves can be formed simultaneously on a bundle of hair irrespectively of the length thereof without having to winding the hair around curlers one by one. The hair bundle can be neutralized thoroughly by immersing the same in the container of neutralizing solution, with the results that the hair is better protected and no excessive neutralizing solution is scattered around and dripped off. Therefore, permanent waves can be formed on hair simply and economically.

Although a certain preferred embodiment has been shown and described, it should be understood that many changes and modifications may be made therein without departing from the scope of the appended claims.

I claim:

1. A method of forming permanent waves on hair, comprising the steps of:

placing a bundle of hair between a pair of corrugated curling members each having a selected area and alternate ridges and grooves at a predetermined pitch with a predetermined curvature, at least one of said corrugated curling members having a plurality of holes defined therethrough;

placing rods in alternate ones of said grooves on an inside of said pair of corrugated curling members with ends of said rods extending laterally beyond said alternate grooves;

looping rubber bands around the exposed ends of said rods and over an outer side of said pair of corrugated curling members for clamping the bundle of hair therebetween;

treating said bundle of hair clamped between said corrugated curling members with a permanent waving solution, thereby forming successive permanent waves on said bundle of hair; and immersing the treated bundle of hair into a hair container containing neutralizing solution.

2. A method according to claim 1 including treating said bundle of hair clamped between said corrugated curling members with permanent waving solution by immersing the bundle of hair and curling members into a container containing permanent waving solution.

* * * * *